US007830349B2

(12) United States Patent
Bu et al.

(10) Patent No.: US 7,830,349 B2
(45) Date of Patent: Nov. 9, 2010

(54) GATE DRIVING APPARATUS

(75) Inventors: Lin-Kai Bu, Tainan County (TW); Chien-Pin Chen, Tainan County (TW); Hsien-Chang Tsai, Tainan County (TW)

(73) Assignee: Himax Technologies, Inc., Tainan County (TW)

( * ) Notice: Subject to any disclaimer, the term of this patent is extended or adjusted under 35 U.S.C. 154(b) by 638 days.

(21) Appl. No.: 11/843,723

(22) Filed: Aug. 23, 2007

(65) Prior Publication Data

US 2007/0285373 A1 Dec. 13, 2007

Related U.S. Application Data

(63) Continuation of application No. 10/787,645, filed on Feb. 26, 2004, now Pat. No. 7,277,077.

(51) Int. Cl.
*G09G 3/36* (2006.01)

(52) U.S. Cl. ..... 345/98; 345/100

(58) Field of Classification Search ..... 345/98, 345/100, 206

See application file for complete search history.

(56) References Cited

U.S. PATENT DOCUMENTS

| | | | | |
|---|---|---|---|---|
| 5,896,115 | A | 4/1999 | Yano et al. | |
| 6,421,038 | B1 | 7/2002 | Lee | |
| 6,621,228 | B2 | 9/2003 | Harada et al. | |
| 6,765,562 | B2 * | 7/2004 | Yamazaki et al. | 345/206 |
| 6,956,552 | B2 | 10/2005 | Yu | |

* cited by examiner

*Primary Examiner*—Kevin M Nguyen
(74) *Attorney, Agent, or Firm*—Thomas, Kayden, Horstemeyer & Risley, LLP

(57) ABSTRACT

A gate driving apparatus for driving a pixel array on a panel. The apparatus includes a driver chip having a first transistor with a gate coupled to receive a Nth gate driving signal, a source coupled to receive a first voltage and a drain coupled to a Nth scan line of the pixel array, and a driving circuit formed on the panel, providing a second voltage to the Nth scan line when the first transistor in the driver chip is turned off by the Nth gate driving signal and providing the first voltage to the Nth scan line when the first transistor is turned on by the Nth gate driving signal.

4 Claims, 10 Drawing Sheets

GATE DRIVING APPARATUS

CROSS REFERENCE TO RELATED APPLICATIONS

This application is a Continuation of application Ser. No. 10/787,645, filed Feb. 26, 2004, which is incorporated herein by reference.

BACKGROUND OF THE INVENTION

1. Field of the Invention

The invention relates to a display apparatus, and more particularly to a TFT gate driving apparatus for driving a pixel array on a panel.

2. Description of the Related Art

FIG. 1 shows a conventional TFT gate driving circuit, which is built into a driver chip 11 and includes pairs of a NMOS and PMOS transistor 111 and 112. In each pair, the drains of the NMOS transistors 111 and PMOS transistor 112 are commonly coupled to a scan line 121 of a pixel array 122 on a panel 12, the sources of the NMOS transistor 111 and PMOS transistor 112 are respectively coupled to receive voltages VGH and VGL, and the gates of the NMOS transistor 111 and PMOS transistor 112 are commonly coupled to a gate driving signal GDS. The NMOS transistor 111 and PMOS transistor 112 are high-voltage devices.

When a high logic level is asserted in the gate driving signal GDS, the NMOS transistor 111 is turned on and the PMOS transistor 112 is turned off, which results in the voltage VGL applied to the scan line 121. Conversely, when a low logic level is asserted in the gate driving signal GDS, the NMOS transistor 111 is turned off and the PMOS transistor 112 is turned on, resulting in the voltage VGH applied to the scan line 121.

Those skilled in the art will appreciate that high-voltage devices occupy a large circuit area. The conventional driving circuit includes a large number of high-voltage devices 111 and 112, which is disadvantageous to size-reduction of the driver chip 11.

BRIEF SUMMARY OF THE INVENTION

The object of the present invention is to provide a gate driving apparatus for driving a pixel array on a panel, wherein the driver chip includes fewer high-voltage devices.

The present invention provides a gate driving apparatus for driving a pixel array on a panel. The apparatus includes a driver chip having a first transistor with a gate coupled to receive a Nth gate driving signal, a source coupled to receive a first voltage and a drain coupled to a Nth scan line of the pixel array, and a driving circuit formed on the panel, providing a second voltage to the Nth scan line when the first transistor in the driver chip is turned off by the Nth gate driving signal and providing the first voltage to the Nth scan line when the first transistor is turned on by the Nth gate driving signal.

A detailed description is given in the following embodiments with reference to the accompanying drawings.

BRIEF DESCRIPTION OF THE DRAWINGS

The invention can be more fully understood by referring to the following detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
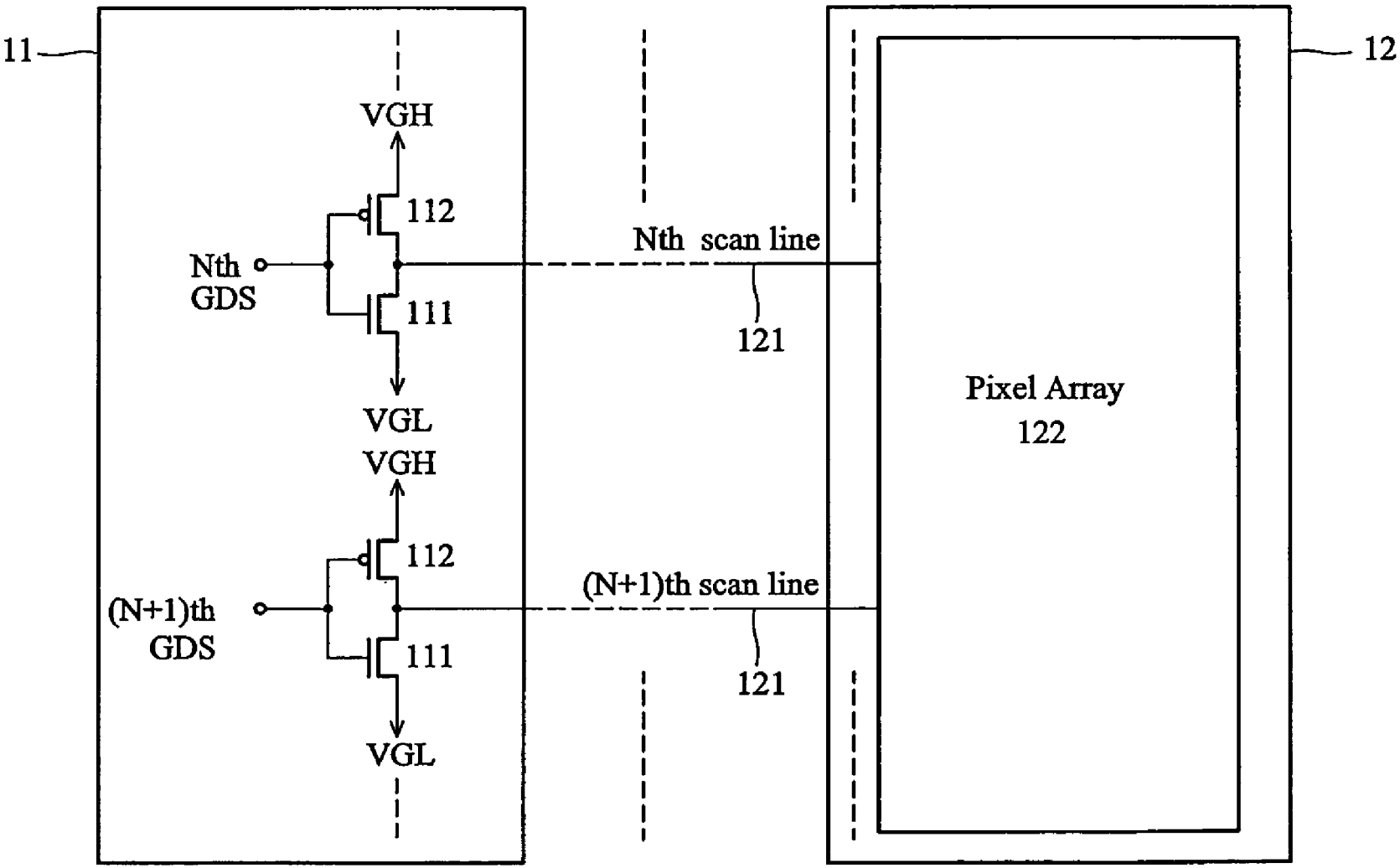
FIG. 1 ( RELATED ART )
FIG. 1 is a diagram showing a conventional TFT gate driving circuit.
Figure 2:
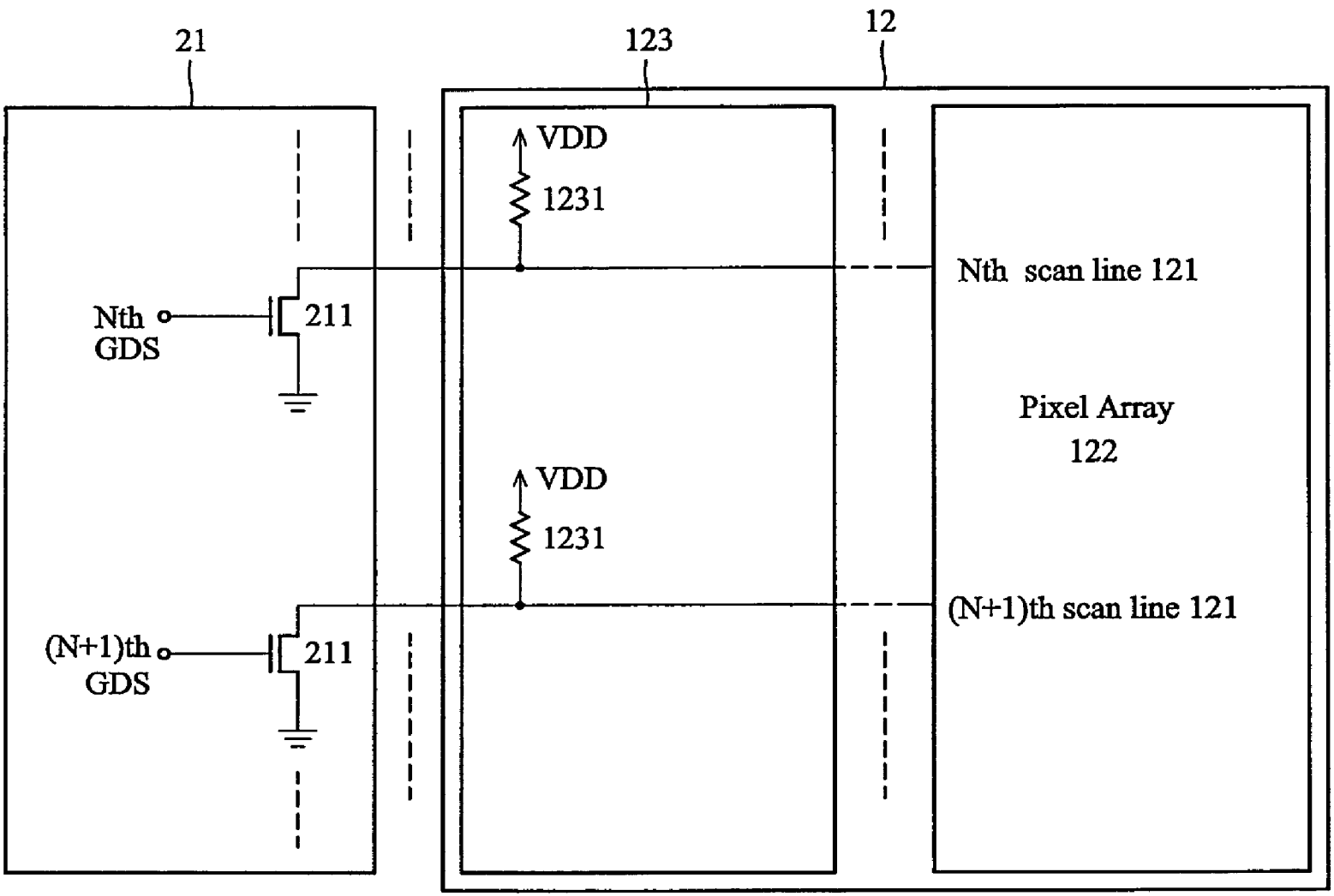
FIG. 2 is a diagram showing a TFT gate driving apparatus according to a first embodiment of the invention.

FIG. 2 is a diagram showing a TFT gate driving apparatus according to a first embodiment of the invention. The TFT gate driving apparatus drives the pixel array 122 on the panel 12, and includes a driver chip 21 and a driving circuit 123 formed on the panel 12. The driver chip 21 includes NMOS transistors 211, wherein the Nth transistor 211 has a gate coupled to receive the Nth gate driving signals GDS, a source coupled to receive a ground voltage and a drain coupled to the Nth scan lines 121 of the pixel array 122. The driving chip 21 provides a voltage VDD to the Nth scan line 121 when the Nth transistor 211 in the driver chip 21 is turned off by the Nth gate driving signal GDS and provides the ground voltage to the Nth scan line 121 when the transistor 211 is turned on by the Nth gate driving signal GDS.

Specifically, the driving circuit 123 includes resistors 1231, wherein one end of the Nth resistor 1231 is coupled to receive the voltage VDD and the other end coupled to the Nth scan lines 121. When the Nth transistor 211 in the driver chip 21 is turned off by the Nth gate driving signal GDS, the voltage on the Nth scan line 121 is (VDD−Vd), wherein Vd is the voltage drop due to the resistor 1231. By properly selecting the resistor 1231, the voltage on the Nth scan line 121 is approximately VDD. When the Nth transistor 211 in the driver chip 21 is turned on by the Nth gate driving signal GDS, the voltage on the Nth scan line 121 is the ground voltage.

Figure 3:
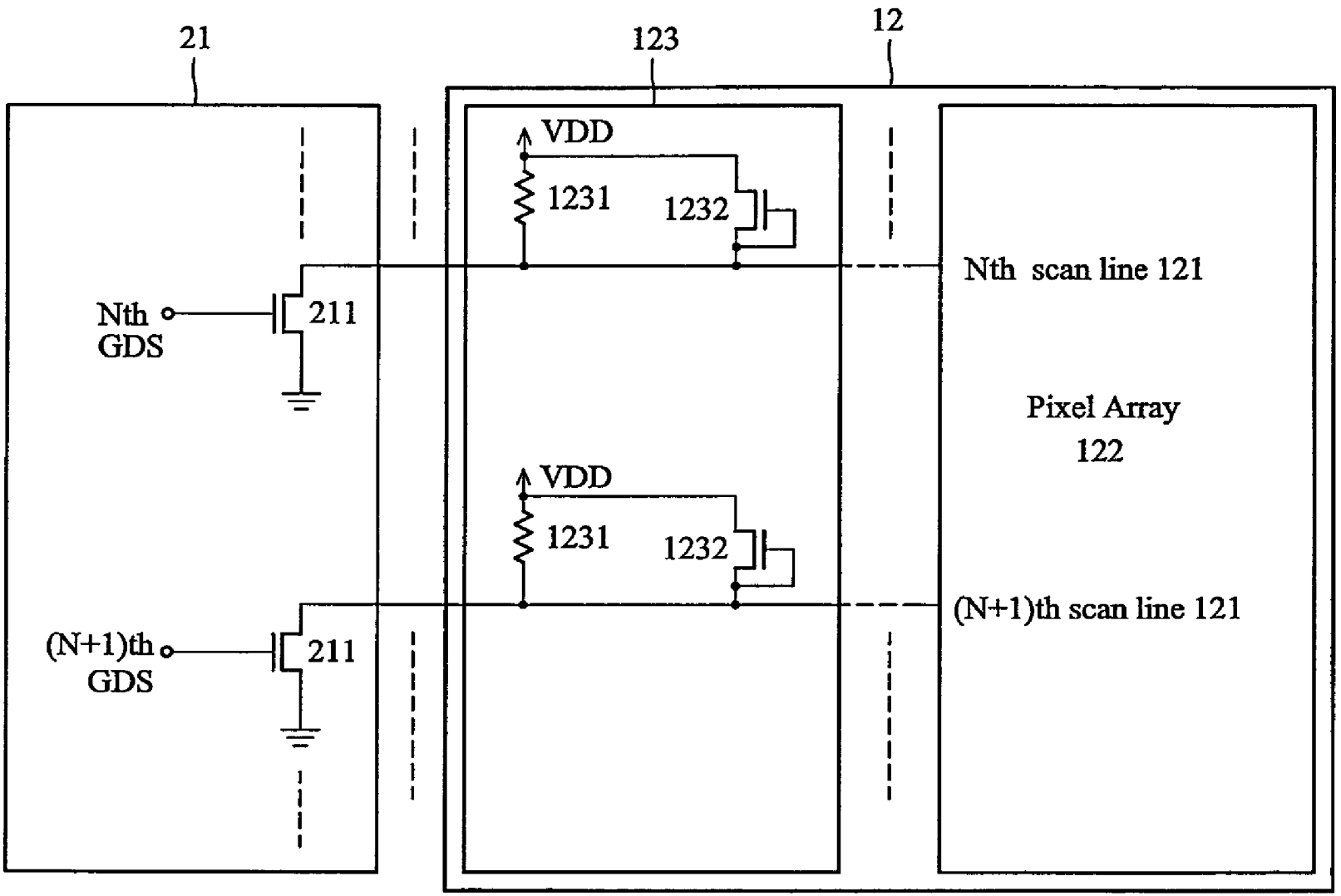
FIG. 3 is a diagram showing a TFT gate driving apparatus according to a second embodiment of the invention.

FIG. 3 is a diagram showing a TFT gate driving apparatus according to a second embodiment of the invention. The apparatus is similar to that shown in FIG. 2 except that the driving chip 21 further includes NMOS TFT (thin film transistor) 1232. The Nth transistor 1232 has a drain and source respectively connected to the ends of the Nth resistor 1231, and a gate connected to the Nth scan line 121.

When the Nth transistor 211 in the driver chip 21 is turned off by the Nth gate driving signal GDS, the Nth transistor 1232 helps to pull up the voltage on the Nth scan line 121 to approximately VDD. When the Nth transistor 211 in the driver chip 21 is turned on by the Nth gate driving signal GDS, the Nth transistor 1232 aids in pulling down the voltage on the Nth scan line 121 to the ground voltage.

Figure 4:
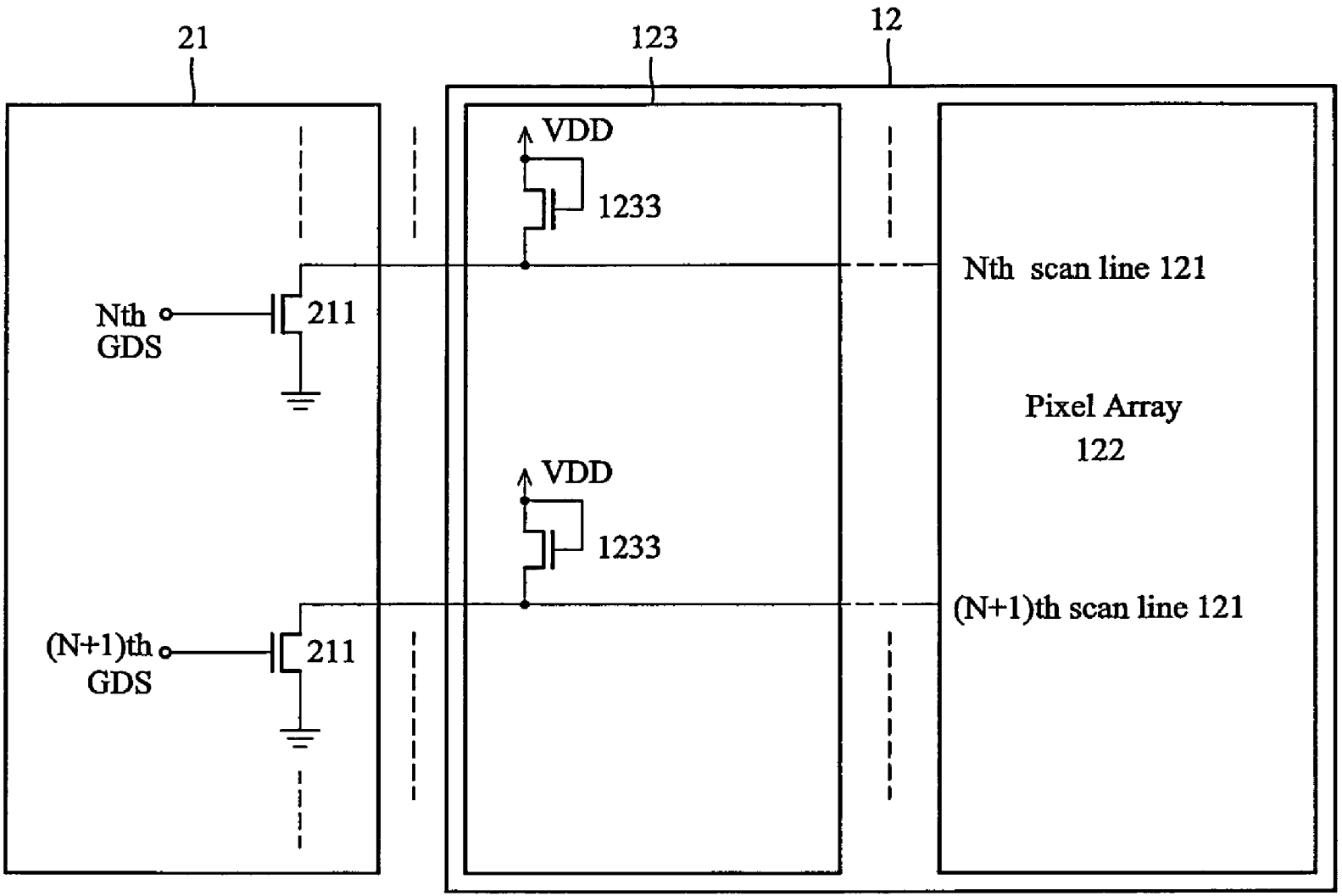
FIG. 4 is a diagram showing a TFT gate driving apparatus according to a third embodiment of the invention.

FIG. 4 is a diagram showing a TFT gate driving apparatus according to a third embodiment of the invention. The apparatus is similar to that shown in FIG. 2 except that the resistors 1231 are replaced by NMOS TFT 1233. The Nth transistor 1233 has a gate and drain commonly coupled to receive the voltage VDD, and a source coupled to the Nth scan line 121. The transistors 1233 act as turned-on diodes equivalent to resistors.

Figure 5:
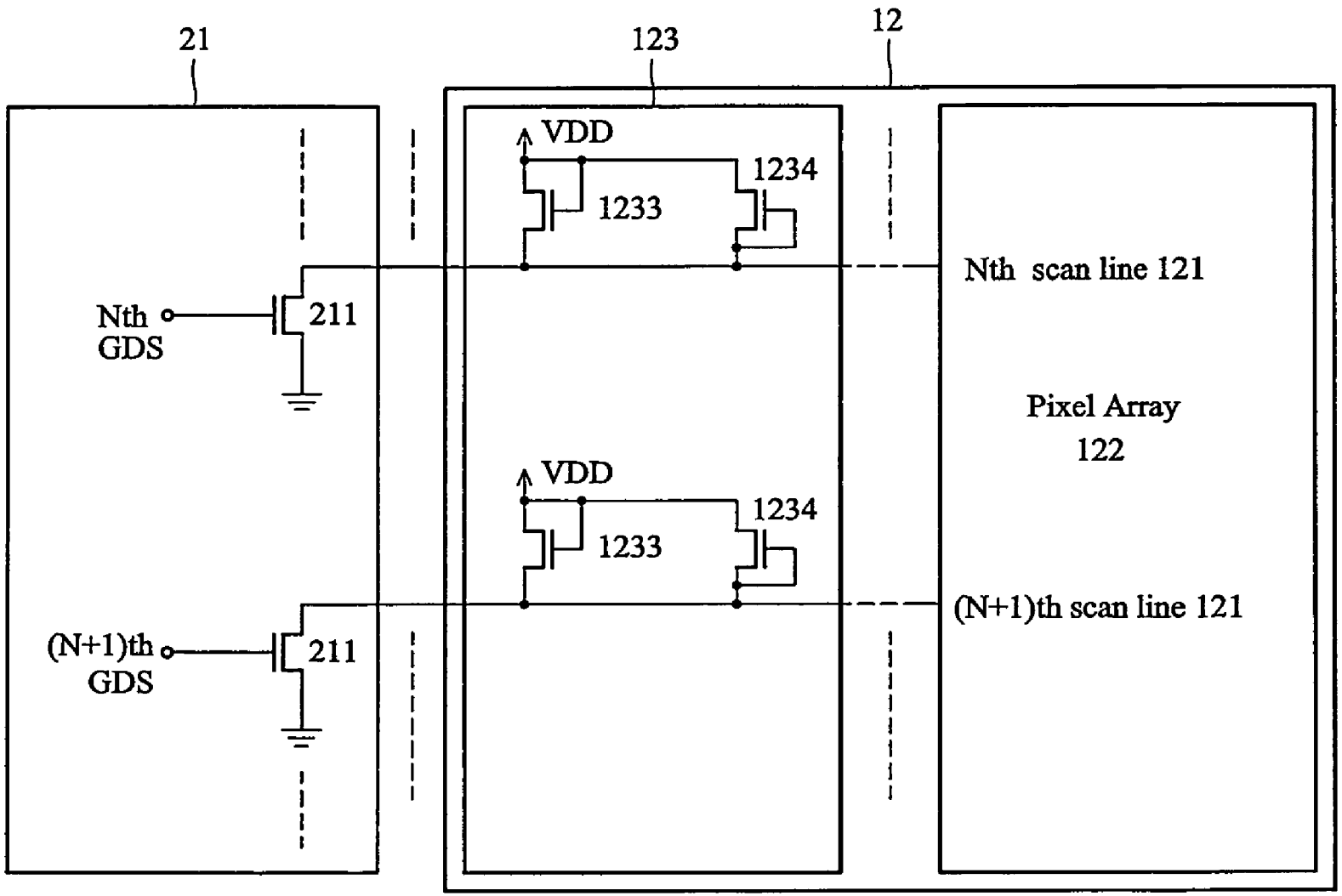
FIG. 5 is a diagram showing a TFT gate driving apparatus according to a fourth embodiment of the invention.

FIG. 5 is a diagram showing a TFT gate driving apparatus according to a fourth embodiment of the invention. It is similar to that shown in FIG. 4 except that the driving chip 21 further includes NMOS TFT 1234. The Nth transistor 1234 has a drain and source respectively connected to the drain and source of the Nth transistor 1233, and a gate connected to the Nth scan line 121.

When the Nth transistor 211 in the driver chip 21 is turned off by the Nth gate driving signal GDS, the Nth transistor 1234 aids in pulling up the voltage on the Nth scan line 121 to approximately VDD. When the Nth transistor 211 in the driver chip 21 is turned on by the Nth gate driving signal GDS, the Nth transistor 1234 aids in pulling down the voltage on the Nth scan line 121 to the ground voltage.

Figure 6:
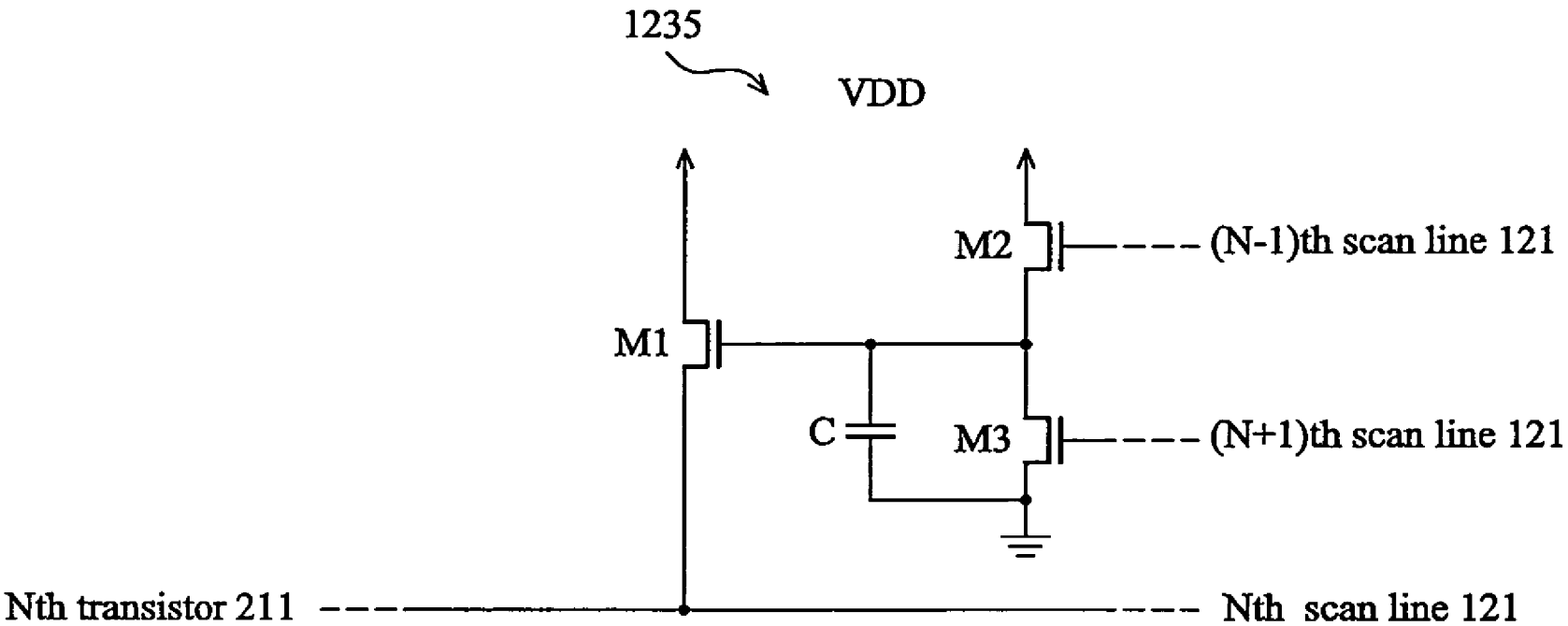
FIG. 6 is a diagram showing a TFT gate driving apparatus according to a fifth embodiment of the invention.

FIG. 6 is a diagram showing a TFT gate driving apparatus according to a fifth embodiment of the invention. It is similar to that shown in FIG. 2 except the resistors 1231 are replaced by sub-circuits 1235. The Nth sub-circuit 1235 includes NMOS TFT M1, M2 and M3, and a capacitor C, wherein the transistor M1 has a drain coupled to receive the voltage VDD and a source coupled to the Nth scan line 121 and a drain of the Nth transistor 211, the transistor M2 has a gate coupled to the (N−1)th scan line 121, a drain coupled to receive the voltage VDD and a source coupled to a gate of the transistor M1, the transistor M3 has a gate coupled to the (N+1)th scan line 121, a drain coupled to the source of the transistor M2 and a source coupled to receive the ground voltage, and the capacitor C is coupled between the gate of the transistor M1 and the source of the transistor M3.

Figure 10:
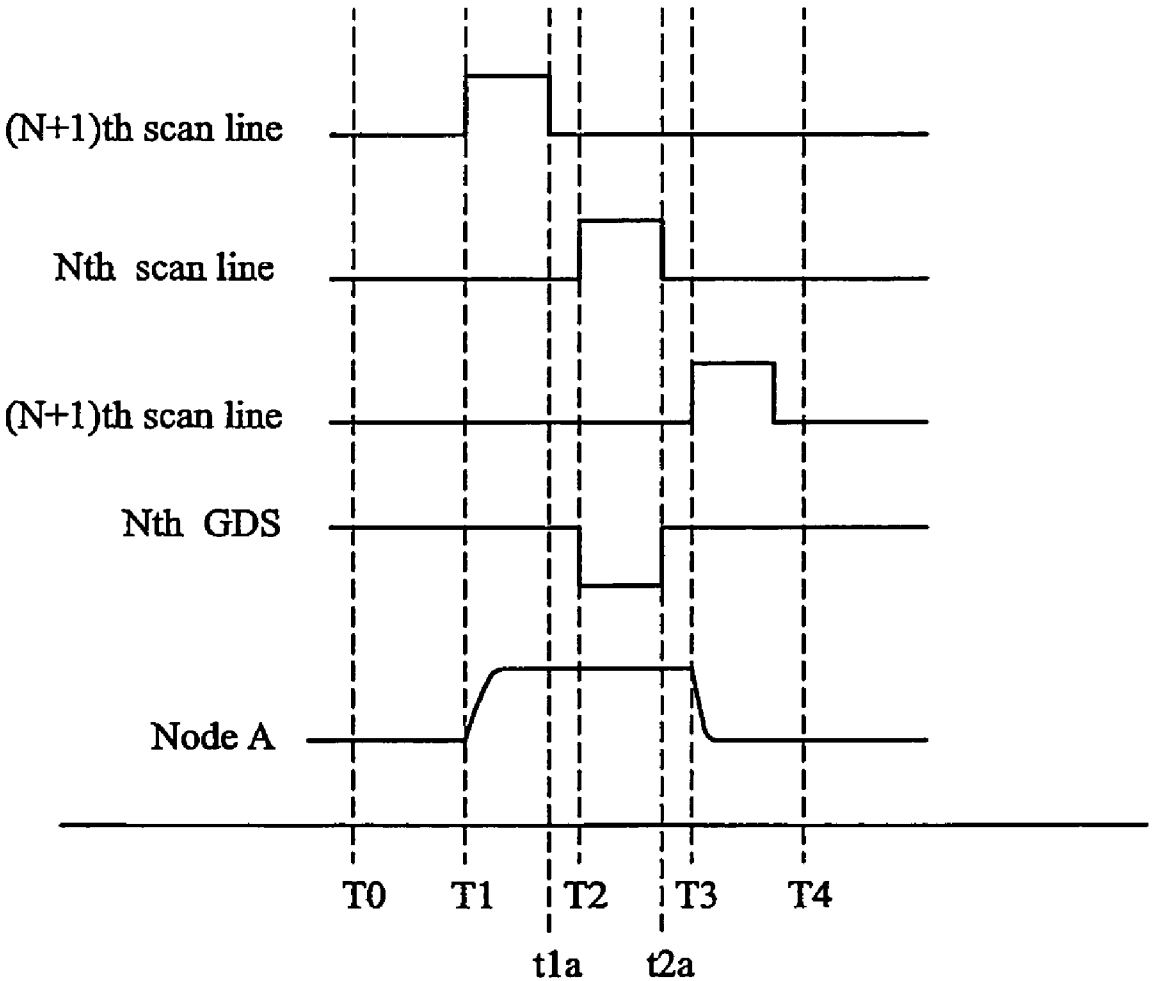
FIG. 10 is a diagram showing the timing of signals used in the driving apparatus of FIG. 6.

FIG. 10 is a diagram showing the timing of the signals used in the driving apparatus of FIG. 6. The operation of the driving apparatus shown in FIG. 6 will be explained in the following with reference to FIG. 10.

During the period from T0 to T1, a high logic level is asserted in the Nth gate driving signal GDS, and the voltages on the (N+1)th and (N−1)th scan line are both at a low logic level. The Nth transistor 211 is turned on while the transistors M2 and M3 in the Nth sub-circuit 1235 are turned off. The voltage on the node A is initially at the low logic level, which turns off the transistor M1 in the Nth sub-circuit 1235. The Nth transistor 211 pulls down the voltage on the Nth scan line to the ground voltage.

During the period from T1 to t1*a*, the Nth gate driving signal GDS stays at the high logic level, the voltage on the (N−1)th scan line is raised to the high logic level and the voltage on the (N+1)th scan line stays at the low logic level. The Nth transistor 211 and the transistor M2 in the Nth sub-circuit 1235 are both turned on while the transistor M3 in the Nth sub-circuit 1235 is turned off. The capacitor C in the Nth sub-circuit 1235 begins charging, which increases the voltage on the node A. The increased voltage on the node A partially turns on the transistor M1 in the Nth sub-circuit, causing a slight increase in the voltage on the Nth scan line. However, since the Nth transistor 211 is completely turned on and has a resistance much smaller than the partially turned-on transistor M1, the voltage on the Nth scan line approximately stays at the ground voltage.

At the time t1*a*, the low logic level is asserted on the (N−1)th scan line, thus the transistor M2 is turned off. However, the voltage on node A still stays at the high logic level because of the capacitor C.

During the period from T2 to t2*a*, the low logic level is asserted both in the Nth gate driving signal GDS and the (N−1)th scan line, and the voltage on the (N+1)th scan line stays at low logic level. The Nth transistor 211, and the transistor M2 and M3 in the Nth sub-circuit 1235 are turned off. The voltage on node A, which stays at the high logic level, completely turns on the transistor M1 in the Nth sub-circuit 1235. Thus, the voltage on the Nth scan line is pulled up to VDD.

At the time t2*a*, the high logic level is asserted in the Nth gate driving signal GDS, so that The Nth transistor 211 is turned on. Since the Nth transistor 211 dominates the performance of the output voltage, the voltage on the Nth scan line is pulled down to the ground voltage primarily by the Nth transistor 211. For example, the Nth transistor is a low-voltage gate and high-voltage drain device with a size much larger than the transistor M1 in the Nth sub-circuit 1235.

At the time T3, the voltage on the (N−1)th scan line stays at low logic level, and the high logic level is asserted both on the (N+1)th scan line and in the Nth gate driving signal GDS. The Nth transistor 211 and the transistor M3 in the Nth sub-circuit 1235 are turned on while the transistor M2 in the Nth sub-circuit is turned off. The capacitor C is discharged, which reduces the voltage on the node A to low logic level.

Figure 7:
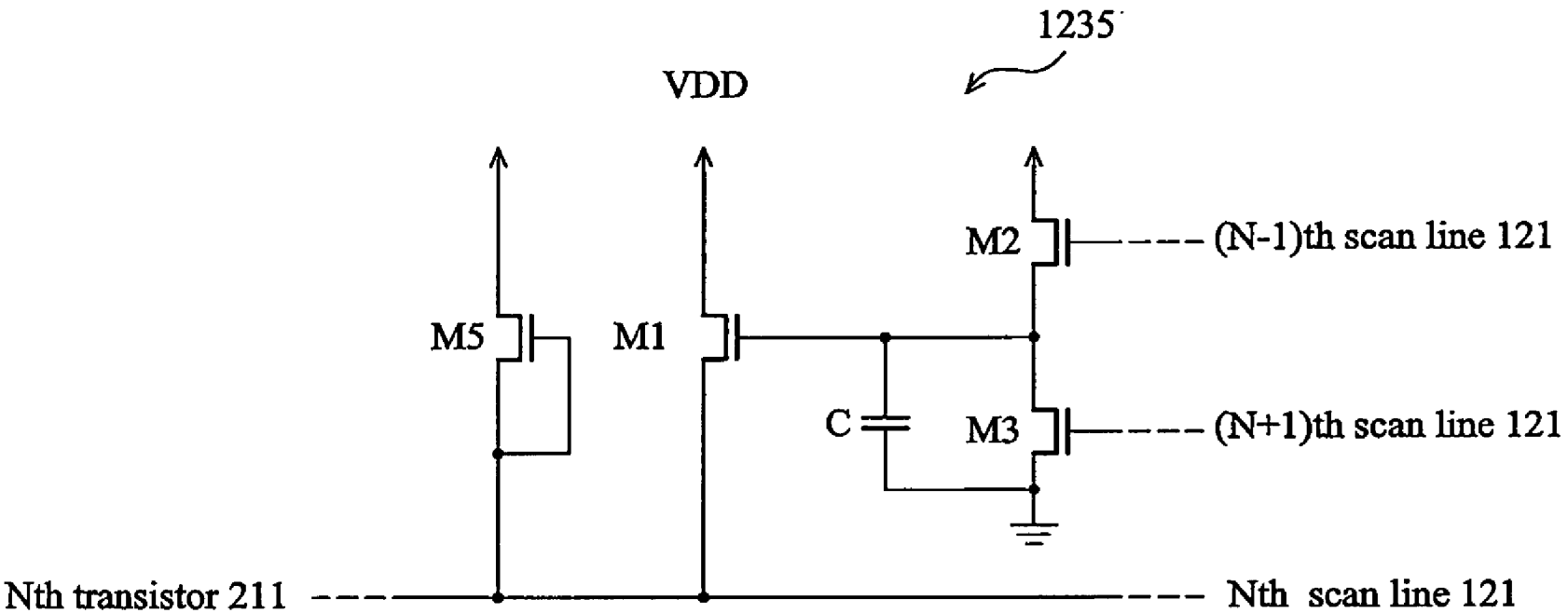
FIG. 7 is a diagram showing a TFT gate driving apparatus according to a sixth embodiment of the invention.

FIG. 7 is a diagram showing a TFT gate driving apparatus according to a sixth embodiment of the invention. The apparatus is similar to that shown in FIG. 6 except that each sub-circuit 1235 further includes an NMOS TFT M5. The transistor M5 in the Nth sub-circuit 1235 has a drain coupled to receive the voltage VDD, and a source and gate commonly coupled to the Nth scan line 121.

When the Nth transistor 211 in the driver chip 21 is turned off by the Nth gate driving signal GDS during the period from T2 to t2*a*, the transistor M5 in the Nth sub-circuit 1235 aids in pulling up the voltage on the Nth scan line 121 to VDD. When the Nth transistor 211 in the driver chip 21 is turned on by the Nth gate driving signal GDS, the transistor M5 in the Nth sub-circuit 1235 aids in pulling down the voltage on the Nth scan line 121 to the ground voltage.

Figure 8:
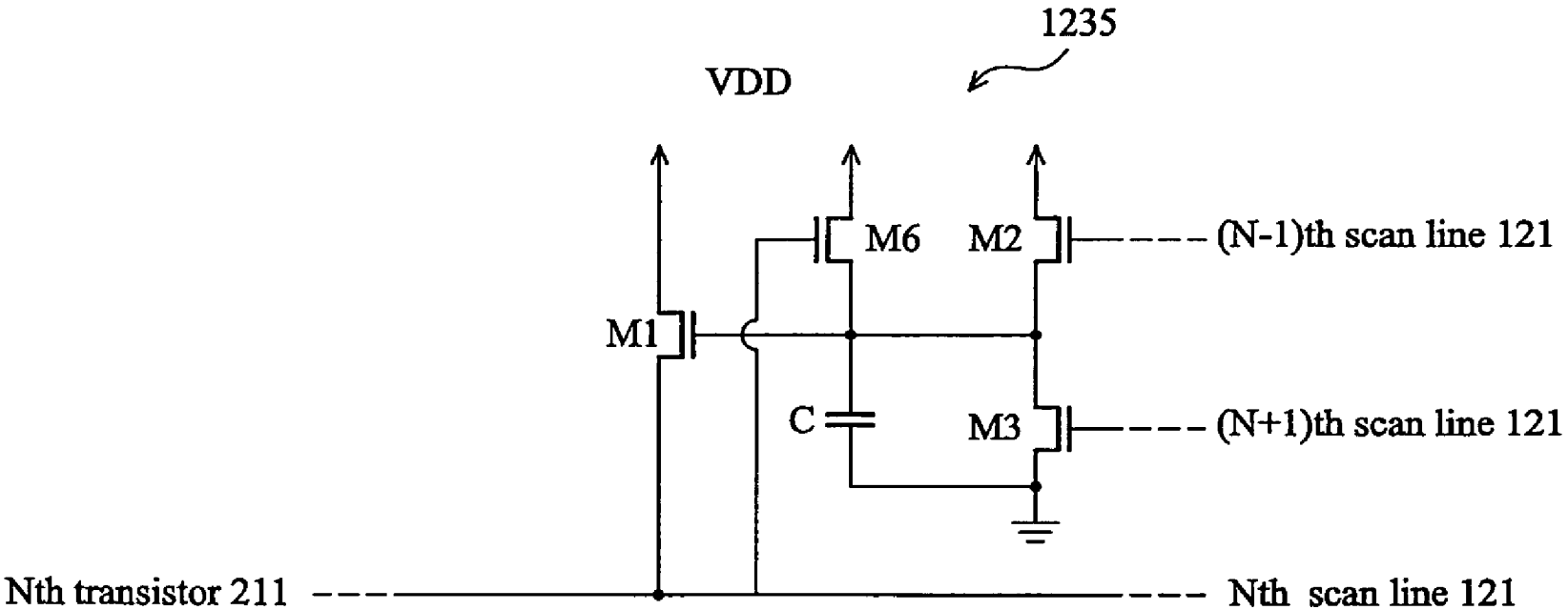
FIG. 8 is a diagram showing a TFT gate driving apparatus according to a seventh embodiment of the invention.

FIG. 8 is a diagram showing a TFT gate driving apparatus according to a seventh embodiment of the invention. The apparatus is similar to that shown in FIG. 6 except that each of the sub-circuit 1235 further includes an NMOS TFT M6. The transistor M6 in the Nth sub-circuit 1235 has a drain coupled to receive the voltage VDD, a source coupled to the gate of the transistor M1 in the Nth sub-circuit and a gate coupled to the Nth scan line 121.

Figure 9:
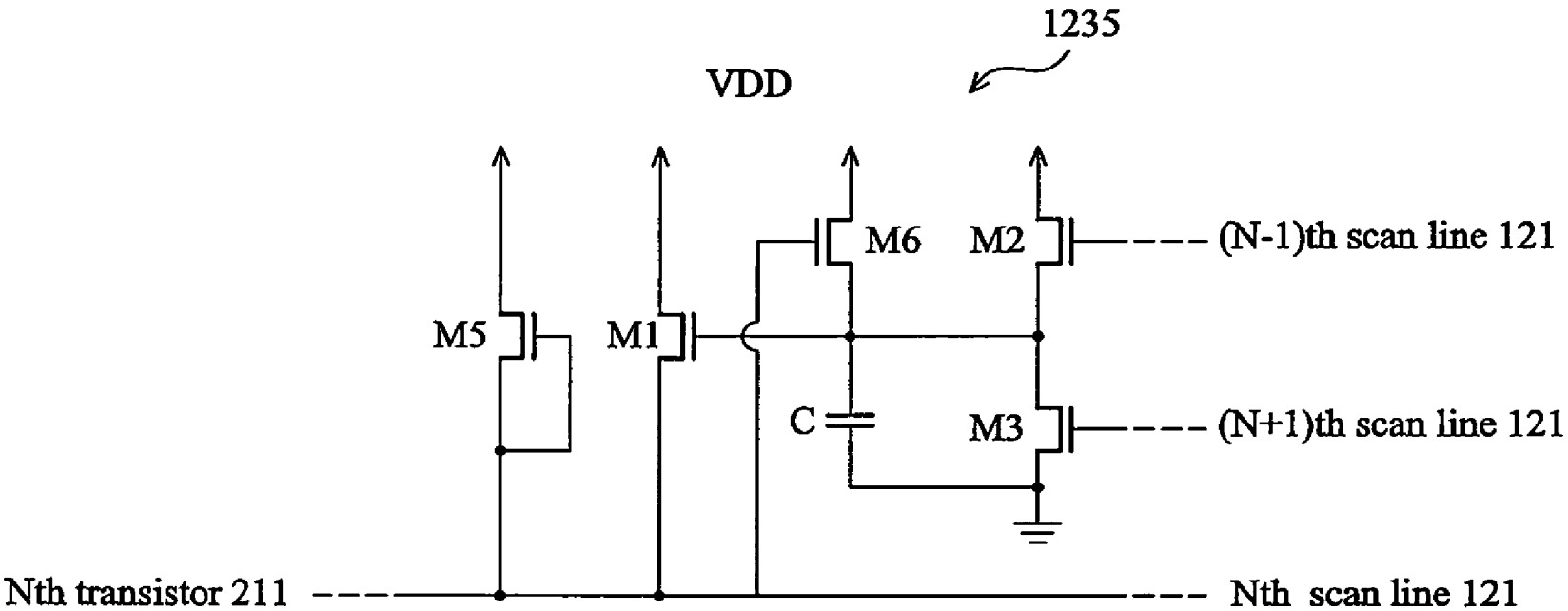
FIG. 9 is a diagram showing a TFT gate driving apparatus according to a eighth embodiment of the invention.

FIG. 9 is a diagram showing a TFT gate driving apparatus according to a eighth embodiment of the invention. The apparatus is similar to that shown in FIG. 6 except that each of the sub-circuit 1235 further includes both transistors M5 and M6 respectively shown in FIG. 7 and 8.

In conclusion, the present invention provides a TFT gate driving apparatus for driving a pixel array on a panel. A driving circuit is provided on the panel to cooperate with the pull-down NMOS transistors in the driver chip. The pull-up PMOS transistors in the conventional driver chip are eliminated. Thus, the driver chip includes low-voltage devices with fewer high-voltage devices or without any high-voltage device.

Moreover, the pull-down NMOS transistor can be replaced by a pull-up PMOS transistor with the modification of circuit configuration in the art. In addition, the NMOS TFT formed on the panel can also be replaced by a PMOS TFT with the modification of circuit configuration in the art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A gate driving apparatus for driving a pixel array on a panel, the apparatus comprising:

a driver chip having a first transistor with a gate coupled to receive a Nth gate driving signal, a source coupled to receive a first voltage and a drain directly connected to an input node of a Nth scan line of the pixel array; and a driving circuit built on the panel and comprising a load directly connected between the input node and a second voltage, wherein when the first transistor in the driver chip is turned off, the Nth scan line is provided with the second voltage via the load, else the Nth scan line is provided with the first voltage via the first transistor, wherein the first voltage is less than the second voltage.

2. The apparatus as claimed in claim 1, wherein the first transistor is a NMOS transistor.

3. The apparatus as claimed in claim 1, wherein a drain of the first transistor is coupled to the driving circuit.

4. A gate driving apparatus for driving a pixel array on a panel, the apparatus comprising:

a driver chip having a first transistor with a gate coupled to receive a Nth gate driving signal, a source coupled to receive a first voltage and a drain directly connected to an input node of a Nth scan line of the pixel array; and a driving circuit built on the panel and comprising a load directly connected between the input node and a second voltage, wherein when the first transistor in the driver chip is turned off, the Nth scan line is provided with the second voltage via the load, else the Nth scan line is provided with the first voltage via the first transistor;

wherein the load comprises a resistor connected between the second voltage and the input node of the Nth scan line, wherein the first voltage is less than the second voltage.

* * * * *